US010777178B2

(12) United States Patent
Ogawa et al.

(10) Patent No.: US 10,777,178 B2
(45) Date of Patent: Sep. 15, 2020

(54) KEYBOARD APPARATUS

(71) Applicant: YAMAHA CORPORATION, Hamamatsu-shi (JP)

(72) Inventors: Kento Ogawa, Funabashi (JP); Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/253,511

(22) Filed: Jan. 22, 2019

(65) Prior Publication Data

US 2019/0156805 A1 May 23, 2019

Related U.S. Application Data

(63) Continuation of application No. PCT/JP2017/024724, filed on Jul. 5, 2017.

(30) Foreign Application Priority Data

Jul. 22, 2016 (JP) ..... 2016-144383

(51) Int. Cl.
*G10H 1/34* (2006.01)
*G10B 3/12* (2006.01)

(52) U.S. Cl.
CPC ..... *G10H 1/346* (2013.01); *G10B 3/12* (2013.01); *G10H 1/34* (2013.01)

(58) Field of Classification Search
CPC ..... G10H 1/346; G10H 1/34; G10B 3/12
See application file for complete search history.

(56) References Cited

U.S. PATENT DOCUMENTS 4,860,630 A * 8/1989 Franz ..... G10C 3/12 84/439
2019/0156804 A1 5/2019 Ogawa

FOREIGN PATENT DOCUMENTS

| | | | |
|---|---|---|---|
| JP | H0511746 | A | 1/1993 |
| JP | H09230866 | A | 9/1997 |
| JP | 2000352978 | A | 12/2000 |
| JP | 2004226687 | A | 8/2004 |
| JP | 2004252246 | A | 9/2004 |
| JP | 2009003102 | A | 1/2009 |
| JP | 2013160780 | A | 8/2013 |
| JP | 2013167790 | A | 8/2013 |

(Continued)

OTHER PUBLICATIONS

International Search Report issued in Intl. Appln. No. PCT/JP2017/024724 dated Sep. 26, 2017. English translation provided.

(Continued)

*Primary Examiner* — Kimberly R Lockett
(74) *Attorney, Agent, or Firm* — Rossi, Kimms & McDowell LLP

(57) ABSTRACT

A keyboard apparatus includes: a key disposed so as to be pivotable with respect to a frame; a first member, an elastic member being disposed on at least a portion of a surface of the first member; a second member configured to be moved on the elastic member while elastically deforming the elastic member in response to pivotal movement of the key; and a hammer assembly connected to the key via the first member and the second member so as to pivot in response to pivotal movement of the key.

17 Claims, 10 Drawing Sheets

(56) References Cited

FOREIGN PATENT DOCUMENTS

JP 2016027730 A 2/2016

OTHER PUBLICATIONS

Written Opinion issued in Intl. Appln. No. PCT/JP2017/024724 dated Sep. 26, 2017. English translation provided.
English Translation of International Preliminary Report on Patentability issued in Intl. Appln. No. PCT/JP2017/024724 dated Jan. 31, 2019.
International Preliminary Report on Patentability issued in Intl. Appln. No. PCT/JP2017/024725 dated Jan. 31, 2019. English translation provided.
International Search Report issued in Intl. Appln. No. PCT/JP2017/024725 dated Sep. 26, 2017. English translation provided.
Written Opinion issued in Intl. Appln. No. PCT/JP2017/024725 dated Sep. 26, 2017. English translation provided.
Office Action issued in U.S. Appl. No. 16/253,456 dated Sep. 20, 2019.
Office Action issued in U.S. Appl. No. 16/253,456 dated Oct. 28, 2019.
Notice of Allowance issued in U.S. Appl. No. 16/253,456 dated May 6, 2020.
Office Action issued in Japanese Appln. No. 2016-144383 dated Jun. 30, 2020. English machine translation provided.

* cited by examiner

KEYBOARD APPARATUS

CROSS REFERENCE TO RELATED APPLICATION

The present application is a continuation application of International Application No. PCT/JP2017/024724, filed on Jul. 5, 2017, which claims priority to Japanese Patent Application No. 2016-144383, filed on Jul. 22, 2016. The contents of these applications are incorporated herein by in their entirety.

BACKGROUND

The present disclosure relates to a keyboard apparatus.

In acoustic pianos, an operation of an action mechanism gives a predetermined feel (hereinafter referred to as "touch feel") to a finger of a player through a key. In particular, an operation of an escapement mechanism gives a collision feel and then gives a falling feel (hereinafter referred to as "click feel" as a whole, for example) as the touch feel to the finger of the player in accordance with the speed of key pressing. Acoustic pianos require an action mechanism for striking a string with a hammer. In electronic keyboard instruments, a sensor detects key pressing, enabling generation of a sound without such an action mechanism provided in the acoustic pianos. A touch feel of an electronic keyboard instrument not using any action mechanism and a touch feel of an electronic keyboard instrument using a simple action mechanism are greatly different from the touch feel of the acoustic piano. To solve this problem, various methods have been discussed in order for electronic keyboard instruments to achieve a touch feel close to that of acoustic pianos as disclosed in Patent Document 1 (Japanese Patent Application Publication No. 2013-167790).

SUMMARY

In order for electronic keyboard instruments to achieve a touch feel close to that of acoustic pianos, not only a click feel but also various elements are combined with each other. One example of the elements is a method of receiving load in response to key pressing. In acoustic pianos, load on key pressing changes variously in accordance with a force of the key pressing due to complexity of the action mechanism. It is demanded that such load is reproduced also in the electronic keyboard instruments.

An object of the present disclosure is to control a touch feel of an electronic keyboard instrument, particularly, load on key pressing.

In one aspect of the present disclosure, a keyboard apparatus includes: a key disposed so as to be pivotable with respect to a frame; a first member, an elastic member being disposed on at least a portion of a surface of the first member; a second member configured to be moved on the elastic member while elastically deforming the elastic member in response to pivotal movement of the key; and a hammer assembly connected to the key via the first member and the second member so as to pivot in response to pivotal movement of the key.

In another aspect of the present disclosure, a keyboard apparatus includes: a key disposed so as to be pivotable with respect to a frame; a first member, an elastic member being disposed on at least a portion of a surface of the first member; a second member configured to be moved in contact with the elastic member and elastically deformed less easily than the elastic member; and a hammer assembly connected to the key via the first member and the second member so as to pivot in response to pivotal movement of the key.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
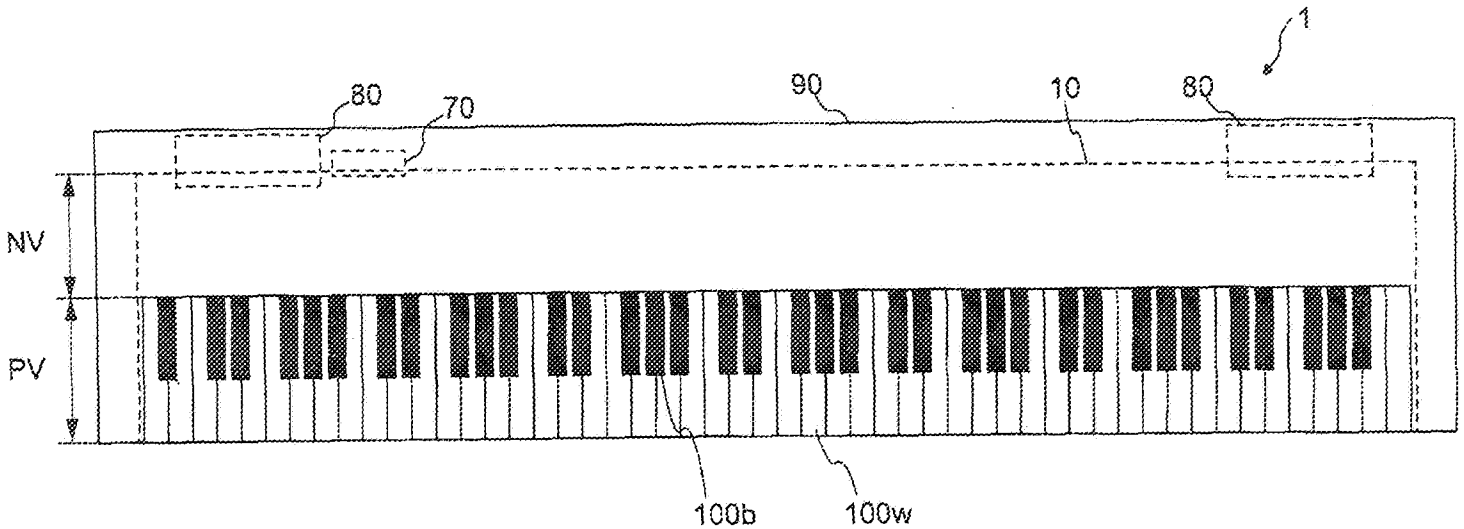
FIG. 1 is a view of a keyboard apparatus according to a first embodiment.

Hereinafter, there will be described embodiments by reference to the drawings. It is to be understood that the following embodiments are described only by way of example, and the disclosure may be otherwise embodied with various modifications without departing from the scope and spirit of the disclosure. It is noted that the same or similar reference numerals (e.g., numbers with a character, such as A or B, appended thereto) may be used for components having the same or similar function in the following description and drawings, and an explanation of which is dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

First Embodiment

Configuration of Keyboard Apparatus

FIG. 1 is a view of a keyboard apparatus according to a first embodiment. In the present embodiment, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b* arranged side by side. The number of the keys 100 is N. In the present embodiment, N is 88. A direction in which the keys 100 are arranged will be referred to as "scale direction". The white key 100*w* and the black key 100*b* may be hereinafter collectively referred to "the key 100" in the case where there is no need of distinction between the white key 100*w* and the black key 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions (sides) respectively indicate directions (sides) in the case where the keyboard apparatus 1 is viewed from the player during playing. Thus, it is possible to express that the non-visible portion NV is located on a back side of the visible portion PV, for example. Also, directions and sides may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
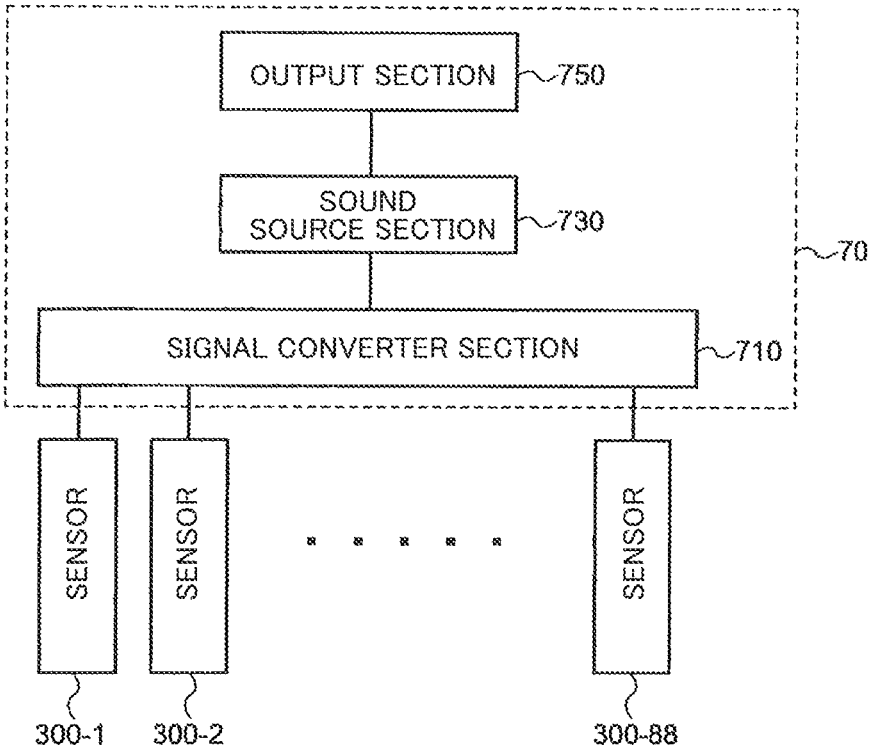
FIG. 2 is a block diagram illustrating a configuration of a sound source device in the first embodiment.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
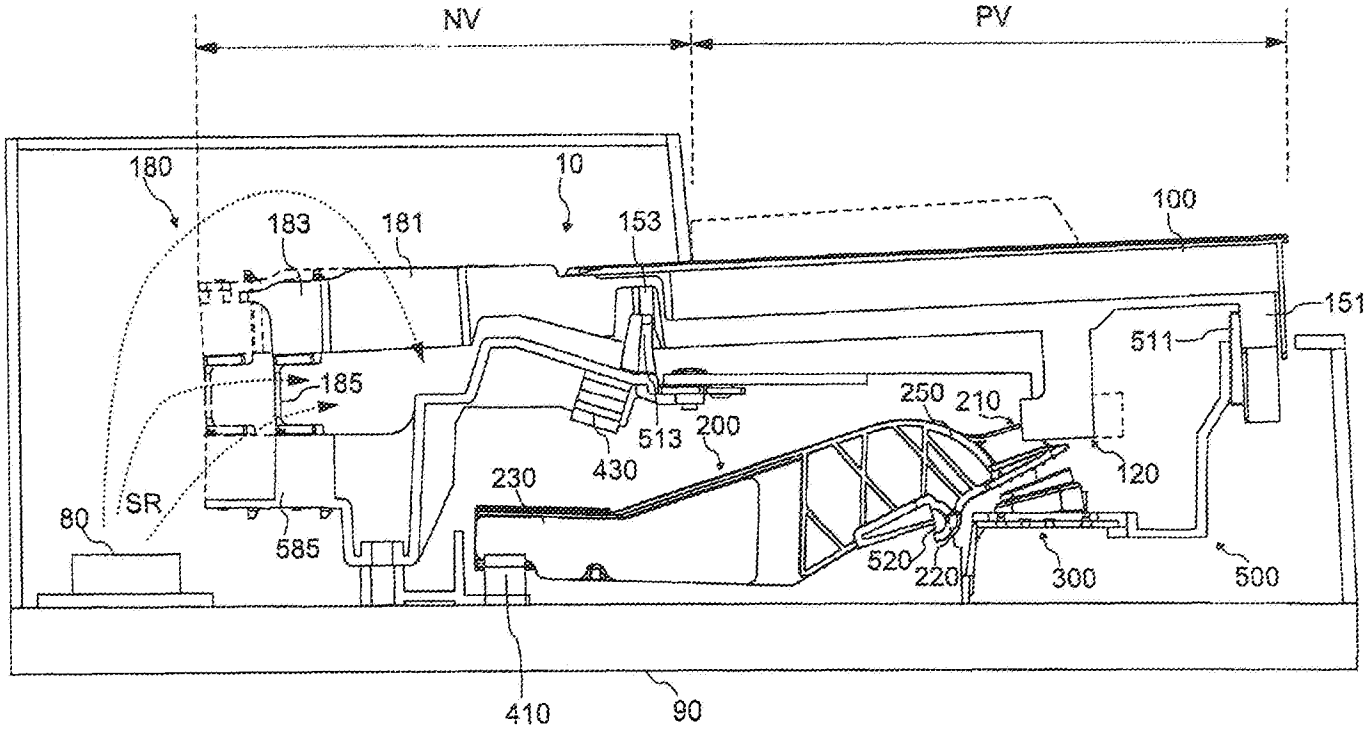
FIG. 3 is a view of a configuration of the inside of a housing in the first embodiment, with the configuration viewed from a lateral side of the housing.

FIG. 3 is a view of a configuration of the inside of the housing in the first embodiment, with the configuration viewed from a lateral side of the housing. As illustrated in FIG. 3, the keyboard assembly 10 and the speaker 80 are disposed in the housing 90. That is, the housing 90 covers at least a portion of the keyboard assembly 10 (a connecting portion 180 and a frame 500) and the speaker 80. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted that paths SR are one example of paths of sounds output from the speaker 80 to a space formed in the keyboard assembly 10, i.e., a space under the keys 100 (the key main body portions).

There will be next described a configuration of the keyboard assembly 10 with reference to FIG. 3. In addition to the keys 100, the keyboard assembly 10 includes the connecting portion 180, a hammer assembly 200, and the frame 500. The keyboard assembly 10 is formed of resin, and a most portion of the keyboard assembly 10 is manufactured by, e.g., injection molding. The frame 500 is fixed to the housing 90. The connecting portion 180 connects the keys 100 to the frame 500 such that the keys 100 are pivotable. The connecting portion 180 includes plate-like flexible members 181, key-side supporters 183, and rod-like flexible members 185. Each of the plate-like flexible members 181 extends from a rear end of a corresponding one of the keys 100. Each of the key-side supporters 183 extends from a rear end of a corresponding one of the plate-like flexible members 181. Each of the rod-like flexible members 185 is supported by a corresponding one of the key-side supporters 183 and a frame-side supporter 585 of the frame 500. That is, each of the rod-like flexible members 185 is disposed between a corresponding one of the keys 100 and the frame 500. When the rod-like flexible member 185 is bent, the key 100 pivots with respect to the frame 500. The rod-like flexible member 185 is detachably attached to the key-side supporter 183 and the frame-side supporter 585. It is noted that the rod-like flexible member 185 may be integral with the key-side supporter 183 and the frame-side supporter 585 or bonded so as not to be attached or detached.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present embodiment, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

A key-side load portion 120 is connected to the key 100 at a lower part of the visible portion PV. When the key 100 pivots, the key-side load portion 120 is connected to the hammer assembly 200 so as to cause pivotal movement of the hammer assembly 200.

The hammer assembly 200 is disposed at a space under the key 100 and attached so as to be pivotable with respect to the frame 500. The hammer assembly 200 includes a weight 230 and a hammer body 250. A shaft supporter 220 is disposed on the hammer body 250. The shaft supporter 220 serves as a bearing for a pivot shaft 520 of the frame 500. The shaft supporter 220 and the pivot shaft 520 of the frame 500 are held in sliding contact with each other in at least three positions.

A hammer-side load portion 210 is connected to a front end portion of the hammer body 250. The hammer-side load portion 210 has a portion in the key-side load portion 120, which portion is held in contact with the key-side load portion 120 so as to be slidable generally in the front and rear direction. The portion of the hammer-side load portion 210 is a moving member 211, which will be described below (see FIG. 4). Lubricant such as grease may be provided on this contacting portion. The hammer-side load portion 210 and the key-side load portion 120 are slid on each other to generate a portion of load when the key 100 is pressed. The hammer-side load portion 210 and the key-side load portion 120 may be hereinafter referred collectively as "load generator". The load generator in this example is located under the key 100 at the visible portion PV (in front of a rear end of the key main body portion). The configuration of the load generator will be described later in detail.

The weight 230 has a metal weight and is connected to the rear end portion of the hammer body 250 (which is located on a back side of a pivot shaft of the hammer assembly 200). In a normal state (i.e., a state in which the key 100 is not pressed), the weight 230 is placed on a lower stopper 410, resulting in the key 100 stably kept at a rest position. When the key 100 is pressed, the weight 230 moves upward and collides against an upper stopper 430. This defines an end position corresponding to the maximum pressing amount of the key 100. This weight 230 also imposes load on pressing of the key 100. The lower stopper 410 and the upper stopper 430 are formed of a cushioning material such as a nonwoven fabric and a resilient material, for example.

Below the load generator, the sensors 300 are mounted on the frame 500. When the sensor 300 is pressed and deformed under a lower surface of the hammer-side load portion 210 in response to pressing of the key 100, the sensor 300 outputs a detection signal. As described above, the sensors 300 correspond respectively to the keys 100.

Configuration of Load Generator

Figure 4:
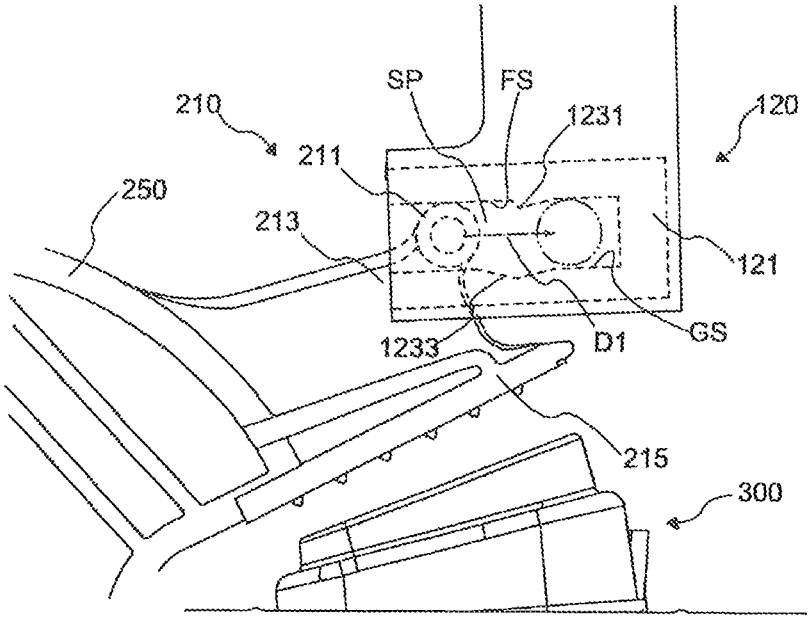
FIG. 4 is a view for explaining a load generator (a key-side load portion and a hammer-side load portion) in the first embodiment.

FIG. 4 is a view for explaining the load generator (the key-side load portion and the hammer-side load portion) in the first embodiment. The hammer-side load portion 210 includes the moving member 211 (as one example of a second member), a rib 213, and a sensor driving member 215 as a plate member. These components are also connected to the hammer body 250. The moving member 211 has a substantially circular cylindrical shape in this example, and the axis of the moving member 211 extends in the scale direction. The rib 213 is connected to a lower portion of the moving member 211. In this example, the direction of the normal to a surface of the rib 213 extends along the scale direction. The sensor driving member 215 is a plate member connected to a lower portion of the rib 213. The direction of the normal to a surface of the sensor driving member 215 is perpendicular to the scale direction. That is, the sensor driving member 215 and the rib 213 are perpendicular to each other. Here, the surface of the rib 213 contains a direction in which the rib 213 is moved by pressing of the key 100. This increases the respective strengths of the moving member 211 and the sensor driving member 215 in a direction in which the moving member 211 and the sensor driving member 215 are moved when the key 100 is pressed. Here, the rib 213 and the sensor driving member 215 serve as a reinforcement for the moving member 211. The moving member 211 and the rib 213 serve as a reinforcement for the sensor driving member 215. With this configuration, the components are reinforced with each other and made strong as a whole when compared with a configuration in which the rib is merely provided. It is noted that, as illustrated in FIG. 4, the moving member 211 is connected to the front end portion of the hammer body 250 via the rib 213. As described above, the weight 230 is connected to the rear end portion of the hammer body 250 (which is located on a back side of the pivot shaft of the hammer assembly 200). That is, the moving member 211 is located on an opposite side of the pivot shaft of the hammer assembly 200 from the weight 230. In other words, the moving member 211 is located on a front side of the pivot shaft of the hammer assembly 200, and the weight 230 is located on a rear side of the pivot shaft of the hammer assembly 200.

The key-side load portion 120 has a sliding-surface forming portion 121. As illustrated in FIG. 4, the sliding-surface forming portion 121 is disposed at a lower end portion of the key-side load portion 120 extending downward from the key 100. That is, the sliding-surface forming portion 121 is disposed on the key 100 at a position where the sliding-surface forming portion 121 is movable downward when the key 100 is pressed. The inside of the sliding-surface forming portion 121 has a space SP in which the moving member 211 is movable. A sliding surface FS is formed above the space SP, and a guide surface GS is formed below the space SP. A region in which at least the sliding surface FS is formed by an elastic member formed of rubber, for example. That is, this elastic member is exposed. In this example, the entire sliding-surface forming portion 121 is formed by the elastic member. This elastic member preferably has viscoelasticity. That is, the elastic member preferably is a viscoelastic member. Since the sliding-surface forming portion 121 is an elastic member, the sliding-surface forming portion 121 is surrounded by a stiff member formed of a material not easily deformed, such as resin having stiffness that is higher than that of the elastic member constituting the sliding-surface forming portion 121. With this configuration, the sliding-surface forming portion 121 is supported so as to maintain the shape of an outer surface of the sliding-surface forming portion 121. This outer surface contains a surface of the sliding-surface forming portion 121 which is opposed to the sliding surface FS. It is noted that the stiffness of the sliding-surface forming portion 121 may gradually increase in its portion extending from the sliding surface FS to the stiff member located outside the outer surface of the sliding-surface forming portion 121. This portion preferably does not contain a component that is elastically deformed more easily than the sliding surface FS, e.g., a component having lower stiffness than the sliding surface FS.

The position of the moving member 211 in FIG. 4 indicates a position when the key 100 is located at the rest position. When the key 100 is pressed, the moving member 211 moves the space SP in the direction indicated by arrow D1 (hereinafter may be referred to as "traveling direction D1") while contacting the sliding surface FS. That is, the moving member 211 is slid relative to the sliding surface FS. Since the moving member 211 moves while contacting the sliding surface FS, the sliding surface FS and the moving member 211 may be hereinafter referred to as "intermittent sliding side" and "continuous sliding side", respectively. Since the moving member 211 is also slightly rotated, and its contact surface is moved, the moving member 211 is not continuously slid strictly, but substantially continuously slid. In any case, the area of the entire portion of the sliding surface FS which is contactable by the moving member 211 in a region in which the sliding surface FS and the moving member 211 are slid in response to pressing of the key 100 is greater than that of the entire portion of the moving member 211 which is contactable by the sliding surface FS.

In response to pressing of the key 100, the entire load generator is moved downward, so that the sensor driving member 215 presses and deforms the sensor 300. In this example, a step 1231 formed in a portion of the sliding surface FS in which the moving member 211 is moved by pivotal movement of the key 100 from the rest position to the end position. That is, the moving member 211 moved from an initial position moves over the step 1231. This initial position is a position of the moving member 211 when the key 100 is located at the rest position. A recess 1233 is formed in a portion of the guide surface GS which is opposed to the step 1231. The recess 1233 makes it easy for the moving member 211 to move over the step 1231. The configuration of the sliding-surface forming portion 121 will be described below in detail.

Configuration of Sliding-Surface Forming Portion

Figure 5C:
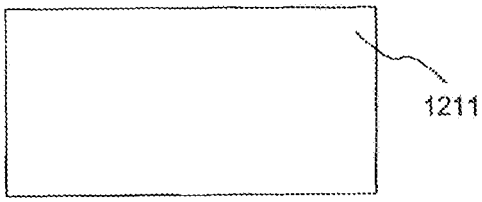
FIGS. 5A through 5E are views for explaining a configuration of a sliding-surface forming portion in the first embodiment.
Figure 5B:
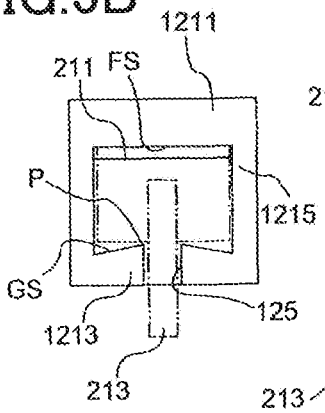
Figure 5A:
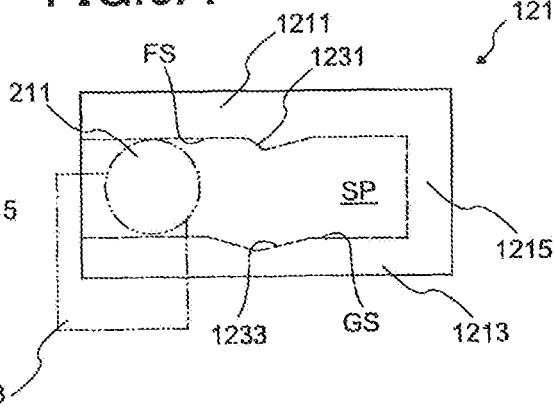
Figure 5E:
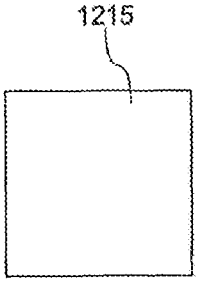
Figure 5D:
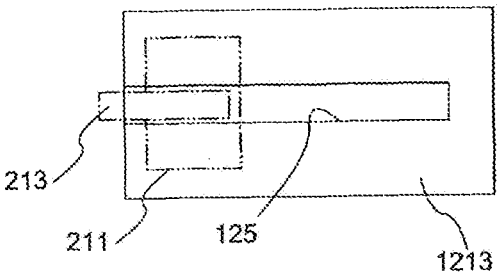

FIGS. 5A through 5E are views for explaining the configuration of the sliding-surface forming portion in the first embodiment. FIG. 5A is a view for specifically explaining the sliding-surface forming portion 121 explained above with reference to FIG. 4, and the broken line in FIG. 5A indicates a configuration in the sliding-surface forming portion 121. FIG. 5B is a view of the sliding-surface forming portion 121 viewed from a rear side thereof (from the key-back-end side). FIG. 5C is a view of the sliding-surface forming portion 121 viewed from an upper side thereof. FIG. 5D is a view of the sliding-surface forming portion 121 viewed from a lower side thereof. FIG. 5E is a view of the sliding-surface forming portion 121 viewed from a front side thereof (from the key-front-end side). It is noted that a region in which the moving member 211 and the rib 213 are located is indicated by the two-dot chain line.

The sliding-surface forming portion 121 includes an upper member 1211 (as one example of a first member), a lower member 1213 (as one example of a third member), and a side member 1215. The upper member 1211 and the lower member 1213 are connected to each other by the side member 1215. The space SP is surrounded by the upper member 1211, the lower member 1213, and the side member 1215. A surface of the upper member 1211 near the space SP is the sliding surface FS. The step 1231 is formed on the sliding surface FS as described above. A surface of the upper member 1211 near the space SP is the guide surface GS. The recess 1233 is formed in the guide surface GS as described above. The guide surface GS guides the moving member 211 so as to prevent the moving member 211 from being located at a distance greater than or equal to a predetermined distance, from the upper member 1211 (the sliding surface FS). That is, as illustrated in FIG. 4, the upper member 1211 is disposed under the key 100, and the lower member 1213 is disposed under the upper member 1211. The lower member 1213 is disposed such that the moving member 211 is interposed between the lower member 1213 and the upper member 1211.

The lower member 1213 has a slit 125. The rib 213 moved with the moving member 211 passes through the slit 125. Though not illustrated in FIGS. 5A-5E, as illustrated in FIG. 4, the sensor driving member 215 is connected to the rib 213 at a position located on an opposite side of the rib 213 from the moving member 211. This configuration establishes a positional relationship in which the lower member 1213 is interposed between the moving member 211 and the sensor driving member 215.

The guide surface GS of the lower member 1213 is inclined so as to be nearer to the sliding surface FS at a portion of the guide surface GS near the slit 125 than at a portion of the guide surface GS far from the slit 125. That is, the lower member 1213 has portions each protruding along the slit 125 in a line shape (hereinafter may be referred to as "protruding portions P"). Thus, the area of contact between the moving member 211 and the guide surface GS is less than that of contact between the moving member 211 and the sliding surface FS. In this example, the moving member 211 is separated from the guide surface GS when the moving member 211 is in contact with the sliding surface FS, and the moving member 211 is separated from the sliding surface FS when the moving member 211 is in contact with the guide surface GS. It is noted that the moving member 211 may be slid while contacting both of the sliding surface FS and the guide surface GS, in at least a portion of a region in which the moving member 211 is movable. While the protruding portions P are provided respectively on opposite sides of the slit 125 in this example, only one of the protruding portions P may be provided on one of opposite sides of the slit 125.

When the key 100 is pressed, a force is applied from the sliding surface FS to the moving member 211. The force transmitted to the moving member 211 causes pivotal movement of the hammer assembly 200 so as to move the weight 230 upward. In this operation, the moving member 211 is pressed downward against the sliding surface FS by the sliding-surface forming portion 121 and moved in the traveling direction D1 with respect to the sliding surface FS. When the key 100 is released, the weight 230 falls downward, which causes pivotal movement of the hammer assembly 200, so that an upward force is applied from the moving member 211 to the sliding surface FS. Here, the moving member 211 is formed of a material less easily deformed than that of the elastic member forming the sliding surface FS, such as resin having higher stiffness than the elastic member forming the sliding surface FS. Thus, when the moving member 211 is pressed against the sliding surface FS, the sliding surface FS is elastically deformed. As a result, movement of the moving member 211 receives various resisting forces in accordance with a force by which the moving member 211 is pressed. These resisting forces will be described with reference to FIGS. 6 and 7.

Figure 6:
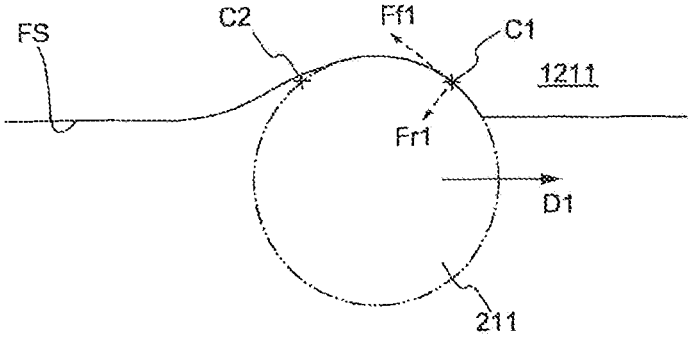
FIG. 6 is a view for explaining elastic deformation of an elastic member in the first embodiment (when a key is strongly struck)
Figure 7:
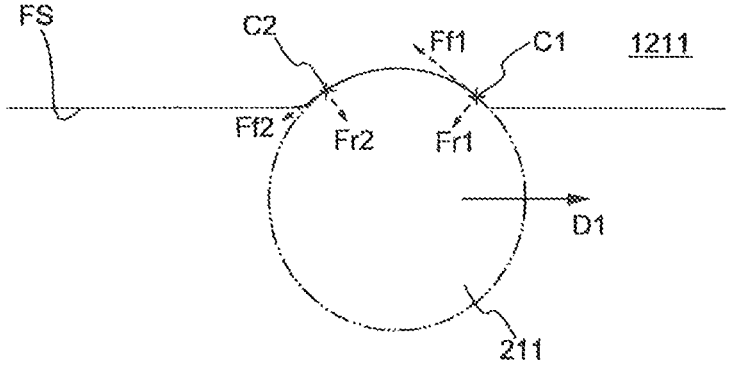
FIG. 7 is a view for explaining elastic deformation of the elastic member in the first embodiment (when a key is weakly struck)

FIG. 6 is a view for explaining elastic deformation of the elastic member in the first embodiment when the key 100 is strongly struck. FIG. 7 is a view for explaining elastic deformation of the elastic member in the first embodiment when the key 100 is weakly struck. When the key 100 is pressed, the moving member 211 is moved in the traveling direction D1. In this movement, since the moving member 211 is pressed against the sliding surface FS of the upper member 1211, the upper member 1211 formed of an elastic material is deformed by its elastic deformation such that the sliding surface FS is recessed.

At the point C1 located on a traveling-direction-D1-side portion of a surface of the moving member 211 (hereinafter may be referred to as "front portion of the moving member 211"), not only a frictional force Ff1 that is a force of friction with the upper member 1211 but also a reactive force Fr1 that is a force by which the moving member 211 is pressed back by the upper member 1211 acts as a resisting force against movement of the moving member 211 in the traveling direction D1. At the point C2 located on a portion of the surface of the moving member 211 which portion is located on an opposite side of the center of the moving member 211 from the traveling-direction-D1-side portion (hereinafter may be referred to as "rear portion of the moving member 211"), the moving member 211 contacts the upper member 1211 when the key 100 is weakly pressed or struck, but the moving member 211 does not contact the upper member 1211 when the key 100 is strongly pressed or struck (see FIG. 6).

The upper member 1211 is elastically deformed by the moving member 211. After the moving member 211 passes through the upper member 1211, the shape of the upper member 1211 is restored to its original shape. When the key 100 is strongly struck, the moving member 211 is moved earlier than the restoration. Thus, a region in which the moving member 211 and the upper member 1211 are not in contact with each other increases in the rear portion of the moving member 211. The region in which the moving member 211 and the upper member 1211 are not in contact with each other increases with increase in viscosity of the upper member 1211 even in the case of the same speed of movement of the moving member 211.

It is noted that a difference between weak strike and strong strike, i.e., a difference in force of pressing of the key 100 affects the degree of elastic deformation. A difference between weak strike and strong strike in the size of the region in which the moving member 211 and the upper member 1211 are not in contact with each other is caused directly by the speed of movement of the moving member 211, specifically. That is, in the case where the speed of key pressing has already increased even if a force of the key pressing is weak, the region in which the moving member 211 and the upper member 1211 are not in contact with each other increases. For example, in the case where the player presses the key 100 while bringing his or her hands down, a force acting on the key 100 is large at the start of the key pressing but decreases immediately, and thereby an amount of elastic deformation decreases, so that the moving member 211 moves at a substantially uniform speed. Since the speed of movement of the moving member 211 is still high, it is difficult for the upper member 1211 to receive a force from the rear portion of the moving member 211 by the effect of the viscosity of the upper member 1211, and the upper member 1211 is greatly affected by the reactive force Fr1 applied from the front portion of the moving member 211, which produces a resisting force against the key pressing.

In the case where the rear portion of the moving member 211 contacts the upper member 1211, the moving member 211 receives not only a frictional force Ff2 but also a reactive force Fr2. The frictional force Ff2 is a resisting force against the traveling direction D1. The reactive force Fr2 is a thrust force for the traveling direction D1. Also, an amount of elastic deformation of the upper member 1211 decreases with decrease in strength of key striking. Thus, the magnitude of the reactive force Fr1 is small, and the area of contact between the moving member 211 and the upper member 1211 is small as a whole, so that the magnitude of the frictional force also decreases. Thus, not only the frictional force but also effects caused by the reactive force are different between the situations in FIGS. 6 and 7. With these configurations, the strength and speed of key pressing enable complicated changes of the resisting force to be received by the moving member 211 in the traveling direction D1. The resisting force received by the moving member 211 also serves as a resisting force to be applied to key pressing. This reproduces changes of the resisting force applied to key pressing in accordance with the strength and speed of key pressing in an acoustic piano. It is also possible to achieve various designs of the resisting force applied to key pressing, by forming the upper member 1211 with a material in which elasticity greatly affected by acceleration (a force of key pressing) and viscosity greatly affected by speed (the speed of key pressing) are adjusted.

It is noted that, when the key 100 has reached the end position, the moving member 211 in some cases bounds to the sliding surface FS and collides against the guide surface GS, depending upon the strength of key pressing. In this case, the protruding portions P of the guide surface GS may be elastically deformed so as to be pressed and deformed by the moving member 211. Due to the presence of the protruding portions P, the area of contact between the moving member 211 and the guide surface GS is less than that of contact between the moving member 211 and the sliding surface FS. Thus, the guide surface GS is elastically deformed more easily than the sliding surface FS even in the case where a force of the same magnitude is applied. Accordingly, even in the case where the moving member 211 collides against the guide surface GS, a smaller collision sound is produced than in the case where the moving member 211 collides against the sliding surface FS.

Operations of Keyboard Assembly

Figure 8A:
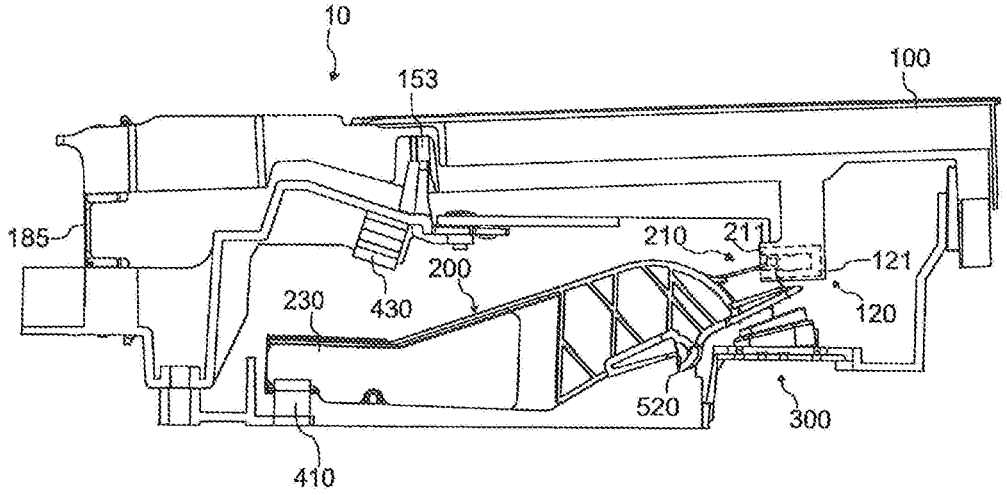
FIGS. 8A and 8B are views for explaining operations of a keyboard assembly when a key (a white key) is depressed in the first embodiment.
Figure 8B:
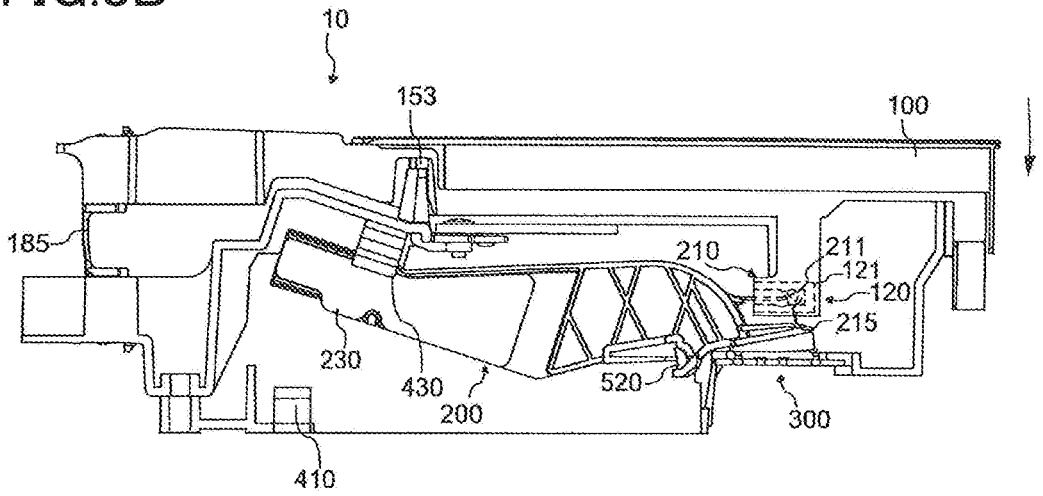

FIGS. 8A and 8B are views for explaining operations of the keyboard assembly when the key (the white key) is depressed in the first embodiment. FIG. 8A illustrates a state in which the key 100 is located at the rest position (that is, the key 100 is not depressed). FIG. 8B illustrates a state in which the key 100 is located at the end position (that is, the key 100 is fully depressed). When the key 100 is pressed, the rod-like flexible member 185 is bent as a pivot center. In this movement, the rod-like flexible member 185 is bent toward a front side of the key 100 (in the front direction), but movement of the rod-like flexible member 185 in the front and rear direction is limited by the side-surface key guide 153, whereby the key 100 does not move frontward but pivots in a pitch direction. The key-side load portion 120 depresses the hammer-side load portion 210, causing pivotal movement of the hammer assembly 200 about the pivot shaft 520. In the explanation for FIGS. 8A and 8B, FIGS. 4-5E are referred for the configuration of the sliding-surface forming portion 121 of the key-side load portion 120.

In the pivotal movement of the hammer assembly 200, the weight 230 is moved upward. Thus, the weight of the weight 230 applies a force to the key 100 so as to move the key 100 toward the rest position (upward). In the load generator (the key-side load portion 120 and the hammer-side load portion 210), the moving member 211 elastically deforms the upper member 1211 during movement in contact with the sliding surface FS, whereby the moving member 211 receives various resisting forces in accordance with a method of key pressing. The resisting forces and the weight of the weight 230 appear as load on key pressing. Also, the moving member 211 moves over the step 1231, whereby a click feel is transferred to the key 100.

When the weight 230 collides against the upper stopper 430, the pivotal movement of the hammer assembly 200 is stopped, and the key 100 reaches the end position. When the sensor 300 is deformed by the sensor driving member 215, the sensor 300 outputs the detection signals in accordance with a plurality of levels of an amount of deformation of the sensor 300 (i.e., the key pressing amount).

When the key 100 is released, the weight 230 moves downward, causing pivotal movement of the hammer assembly 200. With the pivotal movement of the hammer assembly 200, the key 100 pivots upward via the load generator. When the weight 230 comes into contact with the lower stopper 410, the pivotal movement of the hammer assembly 200 is stopped, and the key 100 is returned to the rest position. In this movement, the moving member 211 is returned to the initial position.

Second Embodiment

A sliding-surface forming portion in a second embodiment includes an upper member 1211A having a plurality of regions (portions) that are different in easiness of elastic deformation on the sliding surface FS. In this example, there will be described the upper member 1211A having a region that is elastically deformed more easily than another region, when compared with the upper member 1211 in the first embodiment. This portion may be hereinafter referred to as "weak-elasticity region".

Figure 9:
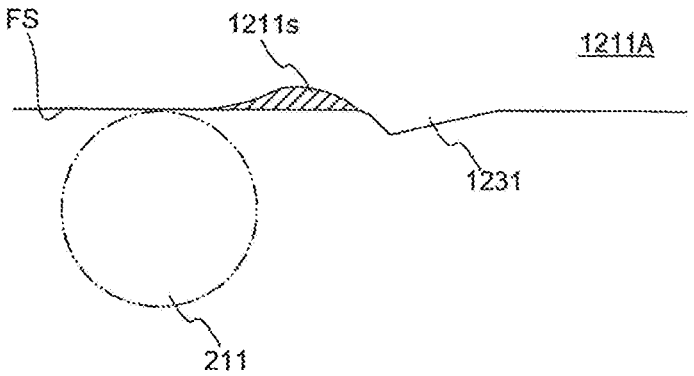
FIG. 9 is a view for explaining a weak-elasticity region in a second embodiment.
Figure 10:
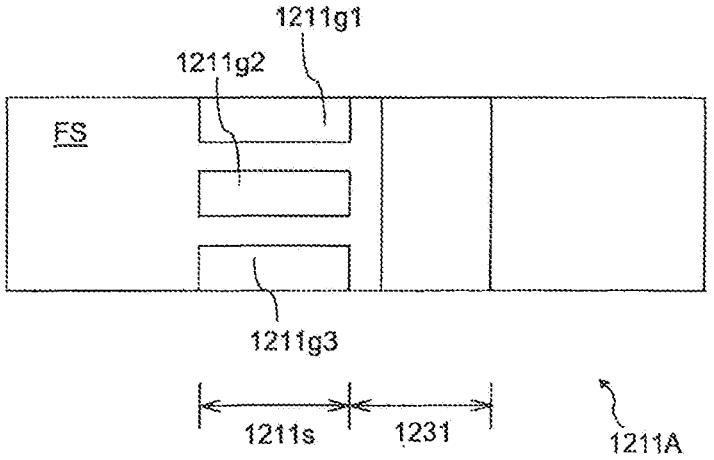
FIG. 10 is a view of the weak-elasticity region in the second embodiment when the weak-elasticity region is viewed from a moving-member side.

FIG. 9 is a view for explaining the weak-elasticity region in the second embodiment. FIG. 10 is a view of the weak-elasticity region in the second embodiment when viewed from a moving-member side. In FIG. 9, the moving member 211 located at the initial position is indicated by the two-dot chain line. The upper member 1211A includes a weak-elasticity region 1211*s* located on one of opposite sides of the step 1231, which one is nearer to the initial position than the other. The weak-elasticity region 1211*s* is elastically deformed more easily than the elastic member constituting a region of the sliding surface FS (i.e., a region contacted by the moving member 211 located at the initial position) which region corresponds to the moving member 211 located at the initial position. As illustrated in FIG. 9, the weak-elasticity region 1211*s* is located between the step 1231 of the sliding surface FS and a region of the sliding surface FS which is contacted by the moving member 211 located at the initial position.

As illustrated in FIG. 10, the weak-elasticity region 1211*s* has grooves 1211*g*1, 1211*g*2, 1211*g*3 formed in the sliding surface FS. These grooves 1211*g*1, 1211*g*2, 1211*g*3 reduce the area of contact between the moving member 211 and the sliding surface FS. With this configuration, a force applied from the moving member 211 is received by the reduced contact portion of the weak-elasticity region 1211*s*. As a result, the weak-elasticity region 1211*s* is elastically deformed more easily than the other regions even in the case where the same force is applied. It is noted that the weak-elasticity region 1211*s* may be formed of a material which is elastically deformed more easily than the other regions. In this case, the weak-elasticity region 1211*s* may not have the grooves 1211*g*1, 1211*g*2, 1211*g*3.

With this configuration in which the weak-elasticity region 1211*s* is provided nearer to the initial position than the step 1231, increase in strength of striking the key 100 increases an amount of elastic deformation of the weak-elasticity region 1211*s*. As a result, when the moving member 211 reaches the step 1231, a component of movement of the moving member 211 along the inclination of the step 1231 increases. This reduces impact when the moving member 211 and the step 1231 collide each other, resulting in a reduced click feel. Accordingly, it is possible to reproduce a phenomenon in which the click feel is reduced when the key 100 is strongly struck in an acoustic piano.

Third Embodiment

A sliding-surface forming portion in a third embodiment includes not only the configuration in the second embodiment but also an upper member 1211B having a weak-elasticity region at least a portion of the step 1231.

Figure 11:
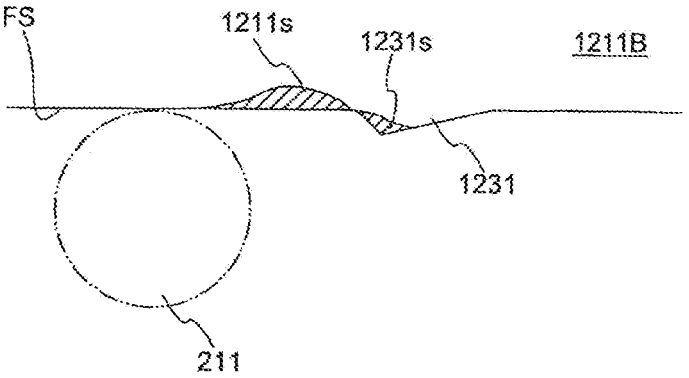
FIG. 11 is a view for explaining a weak-elasticity region in a third embodiment.

FIG. 11 is a view for explaining the weak-elasticity region in the third embodiment. In FIG. 11, the moving member 211 located at the initial position is indicated by the two-dot chain line. The upper member 1211B includes not only the weak-elasticity region 1211*s* in the second embodiment but also a weak-elasticity region 1231*s* formed in the step 1231. The weak-elasticity region 1231*s* has a top of the step 1231. The method for forming the weak-elasticity region 1231*s* is the same as that for the weak-elasticity region 1211*s*.

In the configuration in which the weak-elasticity region 1231*s* is formed at the step 1231, increase with increase in strength of striking the key 100 increases an amount of elastic deformation of the weak-elasticity region 1231*s*. As a result, the moving member 211 is pressed and deformed when moving over the step 1231, and this reduces impact when the moving member 211 and the step 1231 collide each other, resulting in a reduced click feel. Accordingly, it is possible to reproduce a phenomenon in which the click feel is reduced when the key 100 is strongly struck in an acoustic piano. In the third embodiment, the upper member 1211B may include only the weak-elasticity region 1231*s* without including the weak-elasticity region 1211*s*.

Fourth Embodiment

A sliding-surface forming portion in a fourth embodiment includes an upper member 1211C having curved surfaces on the sliding surface FS in addition to the step 1231.

Figure 12:
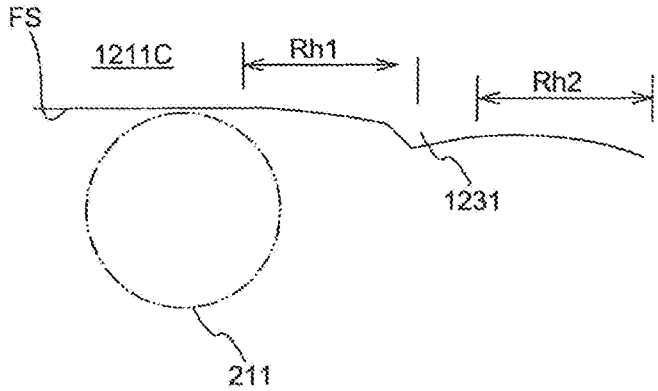
FIG. 12 is a view for explaining a surface shape of a sliding surface in a fourth embodiment.

FIG. 12 is a view for explaining the shape of the sliding surface Fs in the fourth embodiment. In FIG. 12, the moving member 211 located at the initial position is indicated by the two-dot chain line. The upper member 1211C has curved surfaces Rh1, Rh2 on the sliding surface FS. The curved surface Rh1 is located nearer to the initial position than the step 1231 and curved with respect to the direction of movement of the moving member 211. The curved surface Rh2 is located on an opposite side of the step 1231 from the initial position and curved with respect to the direction of movement of the moving member 211.

When the moving member 211 is moved from the initial position in response to key pressing, a force of resistance to movement of the moving member 211 changes in accordance with the degree of curvature of the curved surfaces Rh1, Rh2. In this example, each of the curved surfaces Rh1, Rh2 forms a recessed curved surface. Thus, the resisting force gradually increases with movement of the moving member 211 which is caused by key pressing. That is, the player feels that load on movement of the key 100 increases (becomes heavy) as the player presses the key 100. In this operation, the curved surface Rh1 affects the load in a range of key pressing before generation of the click feel caused by the step 1231. The curved surface Rh2 affects the load in the range of key pressing after generation of the click feel caused by the step 1231.

It is noted that at least one of the curved surfaces Rh1, Rh2 may form a protruding curved surface. In this case, the resisting force gradually decreases with movement of the moving member 211 which is caused by key pressing. That is, the player feels that load on movement of the key 100 decreases (becomes light) as the player presses the key 100. In order to achieve desired changes of load, a recessed curved surface and a protruding curved surface may be combined with each other to form the curved surface. Any one of the curved surfaces Rh1, Rh2 may be omitted. In any case, the shape of the curved surface at least needs to be set in order to achieve changes of load which suit the characteristics of an acoustic piano to be reproduced.

Fifth Embodiment

A sliding-surface forming portion in a fifth embodiment includes an upper member 1211D in which a surface of a portion of the step 1231 near the initial position is a curved surface.

Figure 13:
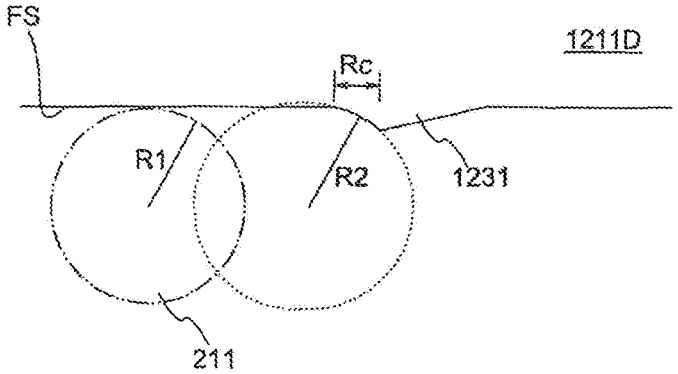
FIG. 13 is a view for explaining a difference in click feel which is related to a curvature radius of a rising portion in a fifth embodiment.

FIG. 13 is a view for explaining the shape of the step 1231 in the fifth embodiment. In FIG. 13, the moving member 211 located at the initial position is indicated by the two-dot chain line. The cross-sectional shape of the moving member 211 cut along the plane whose normal line extends in the scale direction contains a protruding curved surface as an arc at least in a region contacting the sliding surface FS. This arc contains a curvature radius R1. In this example, the cross-sectional shape of the moving member 211 is a round shape with the radius R1.

The cross-sectional shape of a surface of a rising portion Rc of the step 1231 (nearer to the initial position), which surface is cut along the plane whose normal line extends in the scale direction, contains a recessed curved surface as an arc. This arc has a curvature radius R2. In FIG. 13, the circle having the radius R2 is indicated by the broken line. While the entire surface of the rising portion Rc contains the arc having the same curvature radius R2 in this embodiment, the surface of the rising portion Rc may have a plurality of curvature radiuses. In this case, the curvature radius R2 represents the smallest curvature radius in the following explanation.

In the case where the key 100 is strongly pressed or struck, the sliding surface FS is elastically deformed greatly by the moving member 211. Thus, the step 1231 is also elastically deformed greatly. This reduces the size of the step over which the moving member 211 is to move, resulting in a reduced click feel. In the case where the key 100 is weakly pressed or struck, when the moving member 211 moves over the step 1231, effects on the click feel differ depending upon the shape of the rising portion Rc. That is, a relative relationship between the curvature radius R1 and the curvature radius R2 in particular affects the click feel in the case of weak strike.

Figure 14:
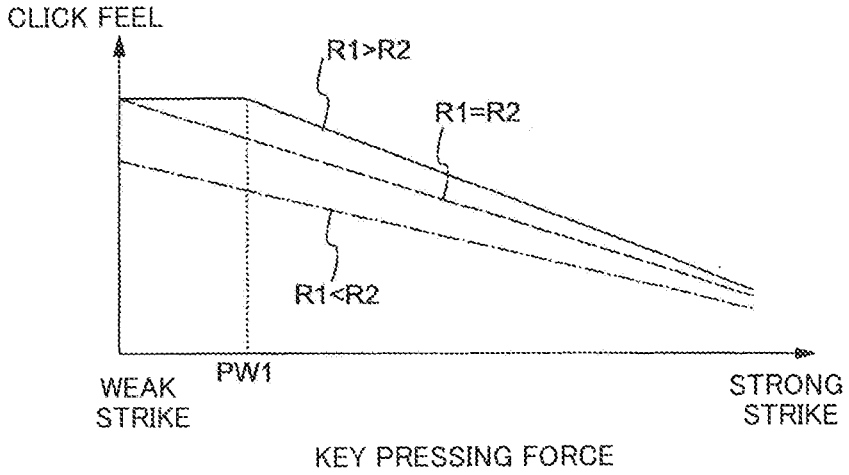
FIG. 14 is a view for explaining a difference in click feel which is related to a shape of a step in the fifth embodiment.

FIG. 14 is a view for explaining a difference in click feel in accordance with the curvature radius of the rising portion Rc in the fifth embodiment. In the case where the curvature radius R1 is greater than the curvature radius R2 (R1>R2), when the key 100 is weakly struck, a middle part of the rising portion Rc and the moving member 211 contact each other due to the relationship of the curvature radius at a time immediately after the moving member 211 comes into contact with the rising portion Rc. Thus, since a direction of movement of the moving member 211 is sharply changed, the moving member 211 collides against the step 1231. Impact caused by the collision affects the click feel.

When the force of key pressing is increased, the moving member 211 is further pressed against the sliding surface FS, so that the rising portion Rc is elastically deformed more greatly. As a result, the rising portion Rc is deformed such that the curvature radius R2 of the rising portion Rc becomes closer to the curvature radius R1 of the moving member 211. The force of key pressing is PW1 in the state in which the curvature radius R2 and the curvature radius R1 are equal to each other as a result of the deformation, i.e., the state in which the shape of the rising portion Rc extends along the shape of the moving member 211. The click feel does not change substantially until the force of key pressing reaches PW1. When the force of key pressing is further increased, the step 1231 is elastically deformed more greatly, so that the moving member 211 easily moves over the step 1231. As a result, the click feel decreases with increase in the force of key pressing.

In the case where the curvature radius R1 and the curvature radius R2 are equal to each other (R1=R2), even when the force of key pressing is small, and elastic deformation of the sliding surface FS is considerably small, the same phenomenon as in the force PW1 occurs in the relationship between the moving member 211 and the rising portion Rc. Thus, a state in the case where the curvature radius R1 and the curvature radius R2 are equal to each other (R1=R2) is substantially the same as a state in the case of "R1>R2" without the range in which the click feel is substantially constant. That is, an amount of elastic deformation of the step 1231 increases with increase in the force of key pressing, so that the moving member 211 can easily move over the step 1231. As a result, the click feel decreases with further increase in the force of key pressing.

In the case where the curvature radius R1 is less than the curvature radius R2 (R1<R2), also when the key 100 is weakly struck, the moving member 211 is movable along the rising portion Rc, and accordingly the direction of movement of the moving member 211 is not changed sharply. As a result, a click feel caused by the moving member 211 moving over the step 1231 is also small. An amount of elastic deformation of the step 1231 increases with increase in the force of key pressing, enabling the moving member 211 to easily move over the step 1231. As a result, the click feel decreases with further increase in the force of key pressing.

Thus, in the case where the curvature radius R1 is greater than the curvature radius R2 (R1>R2), the click feel is substantially constant in a range in which the force of key pressing is small, and decreases when the force of key pressing has increased beyond the range. In the case where the curvature radius R1 is less than or equal to the curvature radius R2 (R1=R2, R1<R2), the click feel is not substantially constant in the case of weak strike and decreases with increase in the force of key pressing. Which case to be selected may be determined in accordance with design of a force of resistance to key pressing.

Sixth Embodiment

In a sixth embodiment, the key 100 and the key-side load portion 120 are indirectly connected to each other.

Figure 15A:
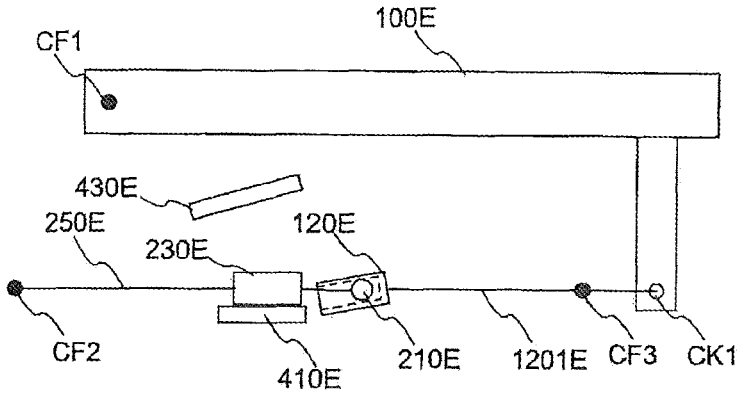
FIGS. 15A and 15B are views for schematically explaining a relationship in connection between a key and a hammer of a keyboard assembly in a sixth embodiment.
Figure 15B:
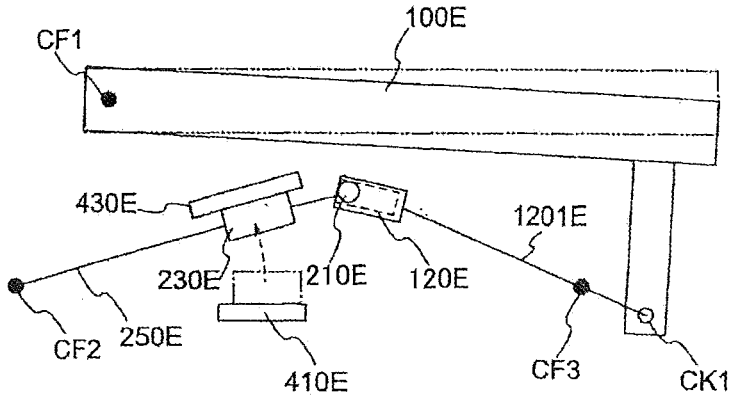

FIGS. 15A and 15B are views for schematically explaining a relationship in connection between the key and a hammer of the keyboard assembly in the sixth embodiment. FIGS. 15A and 15B schematically represent a relationship among the key, the weight, and the load generator. FIG. 15A is a view when a key 100E is located at the rest position before the key 100E is pressed. FIG. 15B is a view when the key 100E is located at the end position after the key 100E is pressed.

The key 100E pivots about the center CF1. The center CF1 corresponds to the rod-like flexible members 185 in the above-described embodiment, for example. A key-side load portion 120E and the key 100E are connected to each other by a structure 1201E. The structure 1201E pivots about the center CF3. One end of the structure 1201E is rotatably connected to the key 100E by a linkage mechanism CK1. The other end of the structure 1201E is connected to the key-side load portion 120E. A hammer body 250E pivots about the center CF2. The center CF2 corresponds to the pivot shaft 520 in the above-described embodiment. A weight 230E is disposed between the center CF2 and a hammer-side load portion 210E.

With this configuration, when the key 100E is pressed, the hammer-side load portion 210E moving in the key-side load portion 120E moves the weight 230E upward until the key-side load portion 120E collides against an upper stopper 430E. That is, the state of the key 100 and the key-side load portion 120 is changed from the state illustrated in FIG. 15A to the state illustrated in FIG. 15B. When the key 100 is released, the weight 230E is moved downward to press the key 100E upward until the weight 230E collides against a lower stopper 410E. That is, the state of the key 100 and the key-side load portion 120 is changed from the state illustrated in FIG. 15B to the state illustrated in FIG. 15A. Thus, as long as the load generator is provided in a path of transfer of a force from the key to the hammer assembly, at least one of the key and the hammer assembly may be directly or indirectly connected to the load generator, enabling various configurations.

Modifications

While the embodiments have been described above, the disclosure may be embodied with various changes and modifications.

While the sensor driving member 215 is connected to the moving member 211 via the rib 213 in the above-described embodiments, the rib 213 may be omitted. In this configuration, the moving member 211 and the sensor driving member 215 at least have to be connected to the hammer body 250. The slit 125 may not be formed in the lower member 1213 in this configuration.

While the entire sliding-surface forming portion 121 is formed of an elastic material in the above-described embodiments, only a portion of the sliding-surface forming portion 121 may be formed of an elastic material. In this configuration, an elastic member only needs to be disposed on the entire region in which the sliding surface FS is formed. That is, a region in which the moving member 211 is contactable with the sliding surface FS only needs to be formed of at least an elastic material in the entire range in which the key 100 is movable.

While the key-side load portion 120 containing the sliding surface FS is connected to the key 100, and the hammer-side load portion 210 containing the moving member 211 is connected to the hammer assembly 200 in the above-described embodiments, this relationship may be reversed. In the case where this relationship is reversed, specifically, the sliding surface FS is formed on the hammer-side load portion 210, and the key-side load portion 120 includes the moving member 211. That is, this keyboard apparatus 1 only needs to be configured such that one of the moving member 211 and the sliding surface FS is connected to the key 100, and the other is connected to the hammer assembly 200.

A portion or the entirety of the lower member 1213 (the guide surface GS) may be omitted. In the case where a portion of the region is left, the guide surface GS only needs to be left on a region in which the moving member 211 easily collides against the guide surface GS. For example, immediately after the key 100 is pressed to the end position, the hammer assembly 200 is kept rotated by an inertial force, whereby the moving member 211 is easily moved off the sliding surface FS. Immediately after the key 100 is returned to the rest position, when the hammer assembly 200 is kept rotated by an inertial force, the moving member 211 in some cases collides with and bounces off the sliding surface FS. In these situations, the moving member 211 easily contacts the guide surface GS. That is, the guide surface GS is preferably disposed at least at opposite end portions of the region in which the moving member 211 is movable.

While the protruding portions P are disposed on the lower member 1213 in the above-described embodiments, the protruding portions P may be omitted. In this configuration, the guide surface GS may be parallel with the sliding surface FS.

The step 1231 may be omitted from the sliding surface FS. In this configuration, the click feel is preferably generated using another method. The click feel may not be generated at least in the load generator. Even in the case where the click feel is not generated, the load generator may use elastic deformation of the sliding surface FS to apply a force of resistance to key pressing.

What is claimed is:

1. A keyboard apparatus, comprising:

a key disposed so as to be pivotable with respect to a frame;

a first member, an elastic member being disposed on at least a portion of a surface of the first member;

a second member configured to be moved on the elastic member while elastically deforming the elastic member in response to pivotal movement of the key; and a hammer assembly connected to the key via the first member and the second member so as to pivot in response to pivotal movement of the key, wherein the elastic member is supported, at a position located on an opposite side of the elastic member from the surface, by a member having greater stiffness than the elastic member.

2. The keyboard apparatus according to claim 1, wherein the elastic member is disposed on the first member in a region in which the second member is contactable with the elastic member in entirety of a range in which the key is movable.

3. The keyboard apparatus according to claim 1, wherein the elastic member is a viscoelastic member.

4. The keyboard apparatus according to claim 1, wherein lubricant is provided between the elastic member and the second member.

5. The keyboard apparatus according to claim 1, wherein one of the first member and the second member is connected to the key, and the other is connected to the hammer assembly.

6. The keyboard apparatus according to claim 1, wherein at least a portion of a surface of the elastic member has a shape curved with respect to a direction of movement of the second member.

7. The keyboard apparatus according to claim 1, wherein the first member comprises a step disposed on a surface of the elastic member, the second member being configured to be moved over the step when the second member is moved from an initial position that is a position of the second member when the key is located at a rest position.

8. The keyboard apparatus according to claim 7, wherein the first member comprises a region that is located between the step and a region of the first member which is contacted by the second member located at the initial position and that is elastically deformable more easily than the region of the first member which is contacted by the second member located at the initial position.

9. The keyboard apparatus according to claim 8, wherein the first member comprises a region that is located at the step and that is elastically deformable more easily than the region of the first member which is contacted by the second member located at the initial position.

10. The keyboard apparatus according to claim 8, wherein the region elastically deformable more easily comprises a groove formed in the surface of the elastic member so as to reduce an area of contact between the elastic member and the second member.

11. The keyboard apparatus according to claim 8, wherein a material elastically deformable more easily than the region of the first member which is contacted by the second member located at the initial position is disposed on the region elastically deformable more easily.

12. The keyboard apparatus according to claim 7, wherein the second member comprises a protruding curved surface having an arc shape in cross section at a surface of the second member which is to contact the first member, and wherein the first member comprises a recessed curved surface having an arc shape in cross section at a rising portion of the step.

13. The keyboard apparatus according to claim 12, wherein a curvature radius of the arc corresponding to the protruding curved surface is less than or equal to a curvature radius of the arc corresponding to the recessed curved surface.

14. The keyboard apparatus according to claim 12, wherein a curvature radius of the arc corresponding to the protruding curved surface is greater than a curvature radius of the arc corresponding to the recessed curved surface.

15. The keyboard apparatus according to claim 1, wherein the hammer assembly comprises a weight, and wherein the first member is configured to, when the key is pressed, allow sliding of the second member on the first member and apply a force to the second member so as to move the weight upward.

16. The keyboard apparatus according to claim 15, wherein the first member is disposed for the key at a position at which the first member is moved downward when the key is pressed, and wherein the second member is connected to the hammer assembly on an opposite side of a pivot axis of the hammer assembly from the weight such that the weight is moved upward when the second member is pressed downward by the first member.

17. A keyboard apparatus, comprising:

a key disposed so as to be pivotable with respect to a frame;

a first member, an elastic member being disposed on at least a portion of a surface of the first member;

a second member configured to be moved in contact with the elastic member and elastically deformed less easily than the elastic member; and a hammer assembly connected to the key via the first member and the second member so as to pivot in response to pivotal movement of the key, wherein the elastic member is supported, at a position located on an opposite side of the elastic member from the surface, by a member having greater stiffness than the elastic member.

* * * * *